United States Patent [19]

Muller

[11] 3,945,188

[45] Mar. 23, 1976

[54] METHOD OF SPINNING SYNTHETIC TEXTILE FIBERS

[76] Inventor: Pierre Muller, Le Moulin, Ternand, 69620 Le-Bois-D'Oingt, France

[22] Filed: Apr. 15, 1974

[21] Appl. No.: 460,897

[30] Foreign Application Priority Data

Apr. 19, 1973 Luxemburg ..... 67466
Dec. 10, 1973 Luxemburg ..... 68957

[52] U.S. Cl. ..... 57/156; 57/2; 57/58.91
[51] Int. Cl.[2] ..... D01H 1/12; D01G 1/08
[58] Field of Search ..... 57/2, 58.89–58.95, 57/156; 19/.32, .35, .41

[56] References Cited

UNITED STATES PATENTS

| | | | |
|---|---|---|---|
| 2,067,062 | 1/1937 | Oswald | 19/.41 |
| 2,721,440 | 10/1955 | New | 57/2 |
| 2,797,444 | 7/1957 | Takagi et al. | 57/2 X |
| 3,377,663 | 4/1968 | Arai et al. | 19/.41 |
| 3,466,861 | 9/1969 | Watson et al. | 57/2 |
| 3,516,241 | 6/1970 | Nakano et al. | 19/.32 X |
| 3,523,300 | 8/1970 | Tabata et al. | 57/58.91 |
| 3,624,996 | 12/1971 | Shepherd et al. | 57/58.91 |
| 3,650,104 | 3/1972 | Shepherd | 57/2 X |

*Primary Examiner*—Donald E. Watkins
*Attorney, Agent, or Firm*—Brisebois & Kruger

[57] ABSTRACT

Method of spinning threads consisting at least partially of synthetic fibers comprising stretch-breaking continuous filaments to obtain fibers having staple length distribution similar to that of natural fibers, crimping said fibers, and open-end spinning them into thread. The invention includes machinery for carrying out this process and its product.

10 Claims, 4 Drawing Figures

METHOD OF SPINNING SYNTHETIC TEXTILE FIBERS

Figure 1:
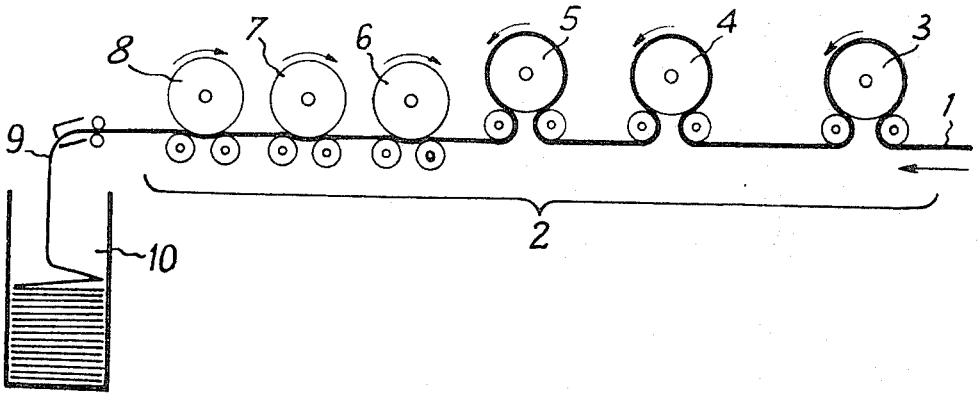

This invention relates to a method of spinning artificial and synthetic textile fibers from continuous filaments alone or from mixtures thereof with natural fibers.

The invention also relates to the threads produced in accordance with this process and to means for carrying out this process.

The spinning of fibers of the cotton type, that is to say, cotton fibers or fibers of other types having a range of staple lengths similar to that of cotton, is generally carried out on continuous spinning machines with the passage through the continuous spinning machine being preceded by the steps of opening the fibers, beating, and carding, and followed by drawing and spindling steps.

For several years spinning frames of the open end type have been in use. Open end spinning consists in drawing a ribbon of fibers by means of a licker-in, for example, and then transporting the fibers in a rotating device, such as a turbine, in which they accumulate in the form of a very thin ribbon of parallel fibers, after which they are twisted together to form a thread which is then received on a bobbin.

While the spinning process utilizing an open end spinning frame has many advantages, there are also disadvantages because of the complex apparatus required from the time the fibers are opened until they are wound on the bobbin and this has a substantial effect on the cost of the machines. Moreover, this apparatus takes up considerable space, thus reducing the space available for other purposes in the mills.

Furthermore, these processes yield only limited results with respect to both the bulk of the threads and their other characteristics. Finally, in the case of synthetic fibers, the results are rendered even less satisfactory because of the distribution of the staple lengths of these fibers, which does not coincide prefectly with the distribution of staple lengths in fibers of the cotton type, which are preferable for these open end spinning processes.

There is also a known process which uses an open end spinning turbine to produce a thread from flat strips mechanically cut from a continuous film of synthetic material. This process does not make it possible to obtain textile threads of a good quality such as those utilized in the clothing industry.

The present invention seeks to overcome these disadvantages and provide a new spinning process which makes it possible to obtain threads of improved quality and increased bulk from artificial and/or synthetic fibers alone, or from mixtures of such fibers with natural fibers.

It is the object of the invention to provide a method of spinning characterized by the fact that continuous artificial or synthetic filaments are stretch broken, and after the broken strip has been subjected to a vaporizing treatment, if desired, this ribbon is spun by the open end method.

In accordance with an advantageous characteristic of the invention the filaments are so broken as to have a staple length distribution of the cotton type.

In accordance with one preferred embodiment of the invention the continuous filaments are advantageously stretch broken by passage of the tow over a stretch break converter which produces a staple length distribution of the wool type, followed by passage over a rebreaker which yields a staple length distribution of the cotton type. As an alternative, the filaments may be broken by a stretch break converter provided at its output end with trains of cylinders which are sufficiently close together to directly produce breaking according to a cotton staple length distribution.

In a particularly advantageous embodiment of the invention the strip, after cracking to produce a staple length distribution of the wool type is passed through a machine of the gill or intersecting type. This step consists in feeding the strip at a speed controlled, for example, by a single or double needle field travelling at substantially the same linear speed at which the material is supplied, the strip being drawn through the needle field at a greater speed by a train of cylinders. After this passage the thin film obtained is then directly rebroken to produce a staple length distribution of the cotton type.

It is easy to produce mixtures with different natural fibers at the input of the intersecting machine so as to produce after rebreaking a longitudinally regular mixture even if this mixture is transversely irregular. Perfect transverse regularity is then obtained during the open ended spinning step without any need for mixing passages.

It is thus possible to produce a particularly regular and homogeneous strip comprising parallel fibers, even when it is formed from fibers of a heterogeneous nature, and one which is particularly well adapted to open end spinning.

In accordance with a preferred embodiment of the invention in which a crimping box of a conventional type is used at the output of the stretch break converter or the rebreaker means, the feed means and the supply licker-in for the turbine of the open end spinning have a width substantially equal to the width of the output of the crimping box and preferably slightly greater than said width. Thus, the width of the licker-in should be not more than 5% more or 5% less than the width of the crimping box. It is preferable that the width of the licker-in be slightly (for example 5%) greater than that of the crimping box.

Under these conditions it is possible to maintain substantially constant, on the one hand, the width of the strip which supplies the licker-in and, on the other hand, the homogeneity of the rectangular section of this strip, so that the work inside the turbine takes place under optimum conditions, thus permitting the production of a thread of improved quality.

This results, in particular, in a better feeding of the strip which passes through a funnel having a section identical to that of the ribbon before the latter is fed to the licker-in by a feeding cylinder equipped with a pressure finger.

Preferably, in order to improve the homogeneity of the metric number of the thread delivered by the open end spinning frame the ribbon is advantageously placed under tension before its introduction into the open end spinning frame.

In this manner the crimped strip is homogenized. This strip has, as a result of the folds of large amplitude which occur in the crimping box, defects in linear homogeneity so that this homogenization is required in order to give the output thread a substantially constant metric number.

The tensioning effect may advantageously be produced by a breaking device acting on the strip and consisting for example of bars making it possible to apply an adjustable pressure by suitable elastic means.

Aside from the long term regularity in the weight of the thread this tensioning device also improves its short term longitudinal regularity when measured, for example, on a regularity meter of the Zellweger Uster type.

This tension may, in certain cases, result in stretching the strip. In a preferred embodiment of the invention the open end spinning of the stretch-broken strip is carried out by means of a spinning machine having an air turbine supplied by a licker-in or a breaking cylinder.

However, the thread may be spun with other spinning frames of the open end type.

The diameter of the licker-in which feeds the turbine of the open end spinning frame may advantageously be increased as compared with the diameters of the licker-s-in of the open end spinning frames now in actual use.

This is especially advantageous because of the fact that certain fibers of the staple lengths used, especially those of the cotton type, are relatively long and are more satisfactorily carded on a licker-in having a large diameter. It has been found that for fibers having a length of 45 mm the diameter must be greater than 60 mm and, in general, the relationship between the length of the fibers and that of the diameter is preferably 1 and 1.5.

The rectangular section of the rebroken ribbon makes it possible to feed the turbine with a greater weight per meter than in previous open end spinning processes of a conventional type, which at the present time use only strips of substantially circular section.

Without departing from the basic principle of the invention it is also possible to subject the broken strip to one or two drawing steps before introducing it into the open end spinning frame. However, in this case, the slight advantage which may result from the drawing is counterbalanced by the disadvantage that the strip supplied to the spinning frame has a circular section instead of a flat rectangular section offering the advantages already set forth.

The threads obtained by the process according to the invention are characterized in part by improved qualities as compared with those of threads of the same nature produced by the conventional spinning of continuous filaments or by open end spinning as heretofore practiced. Moreover, the threads according to the invention have a greater bulk which may be still further increased by suitable vaporization before passage through the open end spinning machine. This bulk improves the covering power of the thread and makes it possible to provide fabrics or tricots which are lighter and thus less expensive.

Figure 2:
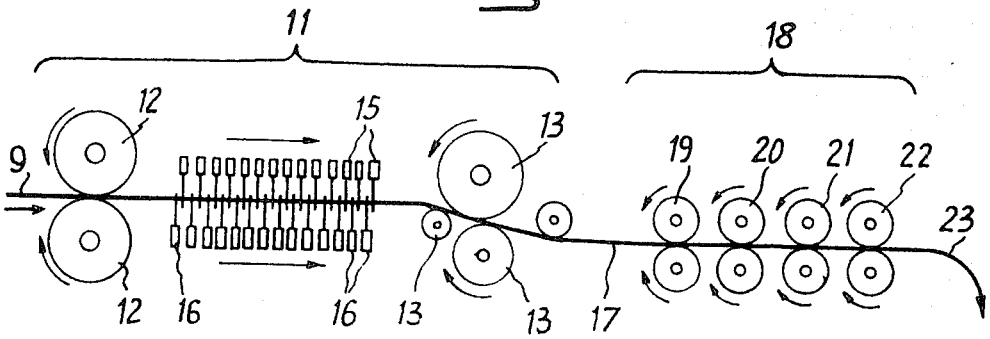
Figure 3:
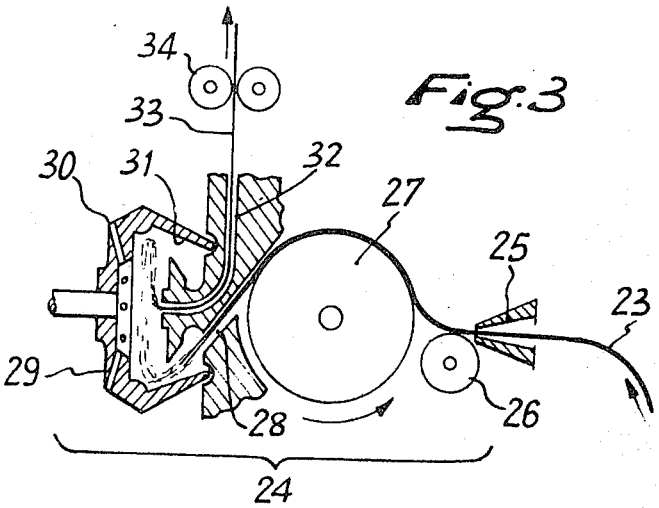
Figure 4:
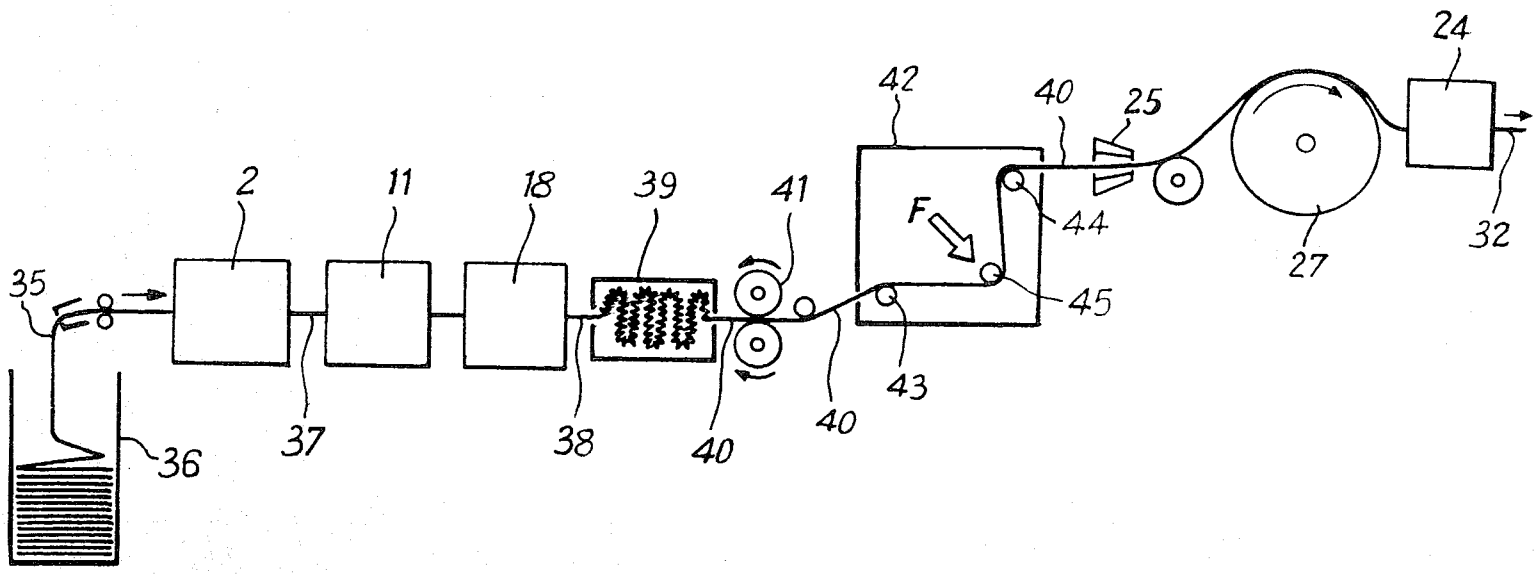

Other advantages and characteristics of the invention will become apparent from a reading of the following description, given purely by way of illustration and example, with reference to the accompanying drawings in which FIGS. 1, 2 and 3 schematically represent a spinning method according to the invention and FIG. 4 illustrates a variation of a process according to the invention.

As shown in FIG. 1 a tow 1 composed of acrylic filaments having a circular or multilobular section and a titre of 2.2 Dtex is acted upon by a stretch break converter 2 comprising in a conventional manner three first groups of cylinders 3, 4, 5 and three second groups of cylinders 6, 7, 8. The space between the groups 3, 4 and 5 decreases successively and the speeds of the cylinders in the different groups increase so as to produce ruptures of continuous filaments by successive stretchings. The speeds of the different trains of cylinders as well as the spacings are adjusted so as to obtain at the output of the stretch break converter 2 a staple length distribution of the wool type, that is to say a distribution of fibers having lengths varying from 40 to 200 mm with an average length of about 70 to 100 mm. The aforesaid stretch break converter may, for example, be a machine of the type "671 S" marketed by the SEYDEL Company of Bielefeld, Germany. The strip of wool-type fibers 9 which leaves the stretch break converter 2 is received in a pot 10 and then fed to a machine 11 (FIG. 2) of the intersecting type such, for example, as the "Intersecting GN 5" preferably equipped with an automatic regulator of the weight of each meter produced sold by the French company N. SCHLUMBERGER & CIE, 68, Guebwiller. Such a machine comprises two feed cylinders 12 and three stretching cylinders 13 driven at a greater speed so as to stretch the strip 9. The linear speed of the cylinders 13 is five to 12 times greater than the speed of the cylinders 12.

Between the cylinders 12 and 13 are two transverse needle fields, an upper field 15 and a lower field 16, each field carrying a plurality of needles vertically directed toward the bottom and top respectively so as to extend through the path of travel of the strip 9. The needle bars 15, 16 are driven in the direction of the arrows at a speed substantially equal to the linear speed of the input cylinders 12. Known mechanisms make it possible to release the needle bars at the end of the path of travel and bring them back to insure continuous circulation of the bars.

The film of fibers 17 which leaves the intersecting machine 11 at the speed of the cylinders 13 comprises parallel fibers which have a reduced mass and an excellent homogeneity with respect to both shape and mass. This strip 17 is introduced into a rebreaking machine 18 comprising for example four trains of cylinders 19, 20, 21, 22 driven at increasing speeds so as to rebreak the fibers to transform the strip from the wool type 17 into a strip of the cotton type 23, that is to say one having fibers 10 to 60 mm in length with an average length of about 25 to 50 mm.

The rebreaking machine 18 may, for example, be a machine of the SEYDEL 750 type sold by the SEYDEL Company of Bielefeld, West Germany. The end cylinders 22 are driven at a speed about twice as great as that of the initial cylinders 19. The strip 23 is then crimped in a crimping box. It is then introduced into a open end spinning machine 24 (FIG. 3) for example of the type BD 200 sold by the Czechoslovakian company, INVESTA, and comprising a condenser in the form of a funnel 25, a grooved feeding roller 26 and a licker-in 27 driven at a variable speed, generally about 7,000 rpm.

In accordance with the invention the transverse width of the licker-in 27 is preferably slightly greater (at most 5% greater) than the width of the outlet orifice of the crimping box. The diameter of the licker-in 27 is from 1 to 1½ times that of the length of the principal fibers constituting the strip 23.

The strip is reformed in an inclined duct 28 which leads excentrically into a turbine 29 having a horizontal axis and driven at a speed of the order of 40,000 rpm.

This turbine 29 has air openings 30 and is so constructed that the fibers of the strip which enter thereinto become separated and spaced over the surface 31 of the turbine in order to be reformed in a duct 32 leading out of the turbine 29.

Thanks to the torsion caused by the rotation of the turbine 29, the fibers in the duct 32 form a thread 33 which is removed by a pair of extractor cylinders 34, after which the thread is wound on a bobbin, not shown.

By way of example a tow 1 composed of synthetic continuous acrylic filaments having a circular section of 1.6 Dtex is introduced at a linear speed of 30 meters per minute into the stretch break converter 2. It leaves this converter at a speed of 150 meters a minute in the form of a strip which is then united with other strips of the same origin or different origin constituted by acrylic fibers or any other natural, artificial or synthetic textile materials so as to form a layer which comprises six to a dozen strips for example. This layer enters the intersecting machine 11. The new ribbon leaving the intersecting machine with a linear speed of 100 meters a minute enters the rebreaking machine from which it leaves through a crimping box in the form of a strip 23 of the cotton type at a speed of 200 meters per minute. This strip is then vaporized for 10 minutes at 115° C. The speed of rotation of the licker-in 27 is 7,000 rpm and the speed of rotation of the turbine 29 is 40,000 rpm. The linear speed of extraction of the cylinders 34 is 55 meters per minute. The resulting thread having a metric number of 40 has the following characteristics:

| | |
|---|---|
| U % Uster | 9 to 9.5% |
| Kilometric resistance | About 9 |
| Coefficient of variation of resistance | 7 to 9% |

By comparison, a thread obtained from identical filaments by conventional spinning has a bulk which is clearly about 30% less and the following characteristics:

| | |
|---|---|
| U % Uster | 11 to 13% |
| Kilometric resistance | About 15 |
| Coefficient of variation of resistance | 10 to 11% |

A thread obtained from the same filaments by the cutting open, drawing, carding, and open end spinning process has the following mechanical characteristics:

| | |
|---|---|
| U % Uster | 10 to 11% |
| Kilometric resistance | About 9 |
| Coefficient of variation of resistance | 9% |

but a bulk about 15 to 20% less than in the case of the process according to the invention.

Referring now to FIG. 4, a tow 35 leaving a card 36 and composed of continuous filaments having a multilobular section of a unitary titre of 1.6 Dtex reaches the stretch break converter 2, while the strip of the woolen type 37 enters a machine of the "Intersecting 11" type either directly or after having been received in a pot.

The parallelized strip which leaves the "Intersecting 11" machine is then introduced either directly or after passage through a pot into a rebreaking machine 18. The ribbon 38 of the cotton type is introduced into a rectangular crimping box of a conventional type 39 within which the ribbon tends to pack down to form a crimp, as is well known. In such crimping boxes 39, in addition to the small undulations which constitute the crimpings proper, it will be seen that the strip also has large undulations which are clearly smaller in number.

These undulations having a large amplitude are the more important because it is preferred in accordance with the invention to very strongly crimp the ribbon in the crimping box 39.

The ribbon 40 which comes out of the crimping box and which is taken in charge by the feed rollers 41 thus has, in addition to small undulations of small amplitude, periodic variations in structure corresponding to the folds of large amplitude which are inevitably formed in the crimping box 39. The crimped ribbon 40 is delivered to a tension device 42 comprising two fixed transverse bars 43, 44 and a movable transverse bar 45, the three bars 43, 44 and 45 being positioned, in the example illustrated, so as to compel the strip 40 to travel through a substantially right angle.

The movable bar 45 is elastically biased in the direction of the arrows F, that is to say transversely with respect to the strip 40, by elastic means such for example as springs, the tension thus imparted being adjustable by a means for adjusting the force applied by said elastic means.

The tension thus applied to the strip 40 homogenizes the strip by eliminating the influence of the fold of large amplitude produced in the crimping box. Moreover, a favorable effect is exerted on the distribution of the undulations of small amplitude constituting the crimping. The invention is of course capable of being modified in many ways. It is thus possible, while less clearly advantageous, to eliminate the passage through the intersecting machine. In like manner, the open end spinning may be carried out by machines, which are already known, by mechanical means, or by hydraulic or electrostatic means.

What is claimed is:

1. Method of spinning threads consisting at least partially of synthetic textile fibers which comprises the steps of stretch breaking continuous filaments of substantially circular section into fibers having a staple length distribution approximating that of natural cotton to obtain a strip of parallel fibers, crimping said strip, and open end spinning said crimped and stretch broken strip.

2. Process as claimed in claim 1 in which the continuous filaments are stretch broken on a stretch break converter into fibers having a staple length distribution approximating that of wool, after which they are rebroken on a rebreaker into fibers having a staple length distribution approximating that of cotton.

3. Process as claimed in claim 2 in which the broken fibers are passed through a machine of the intersecting or gill type after breaking and before rebreaking.

4. Process as claimed in claim 1 after breaking, a strip of said fibers is crimped in a crimping box and the width of the feed means and the licker-in supplying the open end spinning frame is substantially equal to the width of the crimping box.

5. Process as claimed in claim 4 in which the difference in width between the licker-in and the crimping box is as equal at most to 5% with the width of the licker-in being the greater.

6. Process as claimed in claim 1 in which, before feeding the strip to the open end spinning frame, the strip is passed over a device for placing it under tension.

7. Process as claimed in claim 6 in which the strip is passed over a tensioning device comprising a tensioning bar biased transversely with respect to the ribbon.

8. Process as claimed in claim 1 in which the open end spinning is carried out on a machine comprising an air turbine.

9. Process as claimed in claim 1 in which the strip is passed over a licker-in to an open end spinning frame having a diameter such that the ratio between the length of the longest fibers and said diameter lies between 1 and 1.5.

10. Process as claimed in claim 1 in which the strip is vaporized after stretch breaking and before open end spinning.

* * * * *